United States Patent [19]

Ishigami et al.

[11] 3,980,987

[45] Sept. 14, 1976

[54] BRAKE FAILURE INDICATOR

[75] Inventors: Noriakira Ishigami, Chiryu; Asao Kozakai, Okazaki; Masakazu Ishikawa, Toyota; Takaaki Ota, Okazaki, all of Japan

[73] Assignees: Aisin Seiki Kabushiki Kaisha, Kariya; Toyota Jidosha Kogyo Kabushiki Kaisha, Toyota, both of Japan

[22] Filed: Dec. 2, 1974

[21] Appl. No.: 528,881

[30] Foreign Application Priority Data

Dec. 5, 1973 Japan ..... 48-141373[U]

[52] U.S. Cl. ..... 340/52 C; 303/84 A; 200/82 D

[51] Int. Cl.[2] ..... H01H 35/38

[58] Field of Search ..... 340/52 C; 303/6 C, 84 A; 200/82 D

[56] References Cited

UNITED STATES PATENTS

| | | | |
|---|---|---|---|
| 3,394,401 | 7/1968 | Roberts | 200/82 D |
| 3,475,573 | 10/1969 | Maltais et al. | 340/52 C X |
| 3,632,924 | 1/1972 | Harper | 200/82 D |
| 3,662,370 | 5/1972 | Barnes | 303/84 A X |

*Primary Examiner*—Alvin H. Waring
*Attorney, Agent, or Firm*—Pierce, Scheffler & Parker

[57] ABSTRACT

Apparatus for providing an indication to a vehicle operator of failure of either of separated fluid braking circuits by means of an electric circuit, which electric circuit is further enabled to provide such indication in response to self-deactuation of the electric circuit.

5 Claims, 1 Drawing Figure

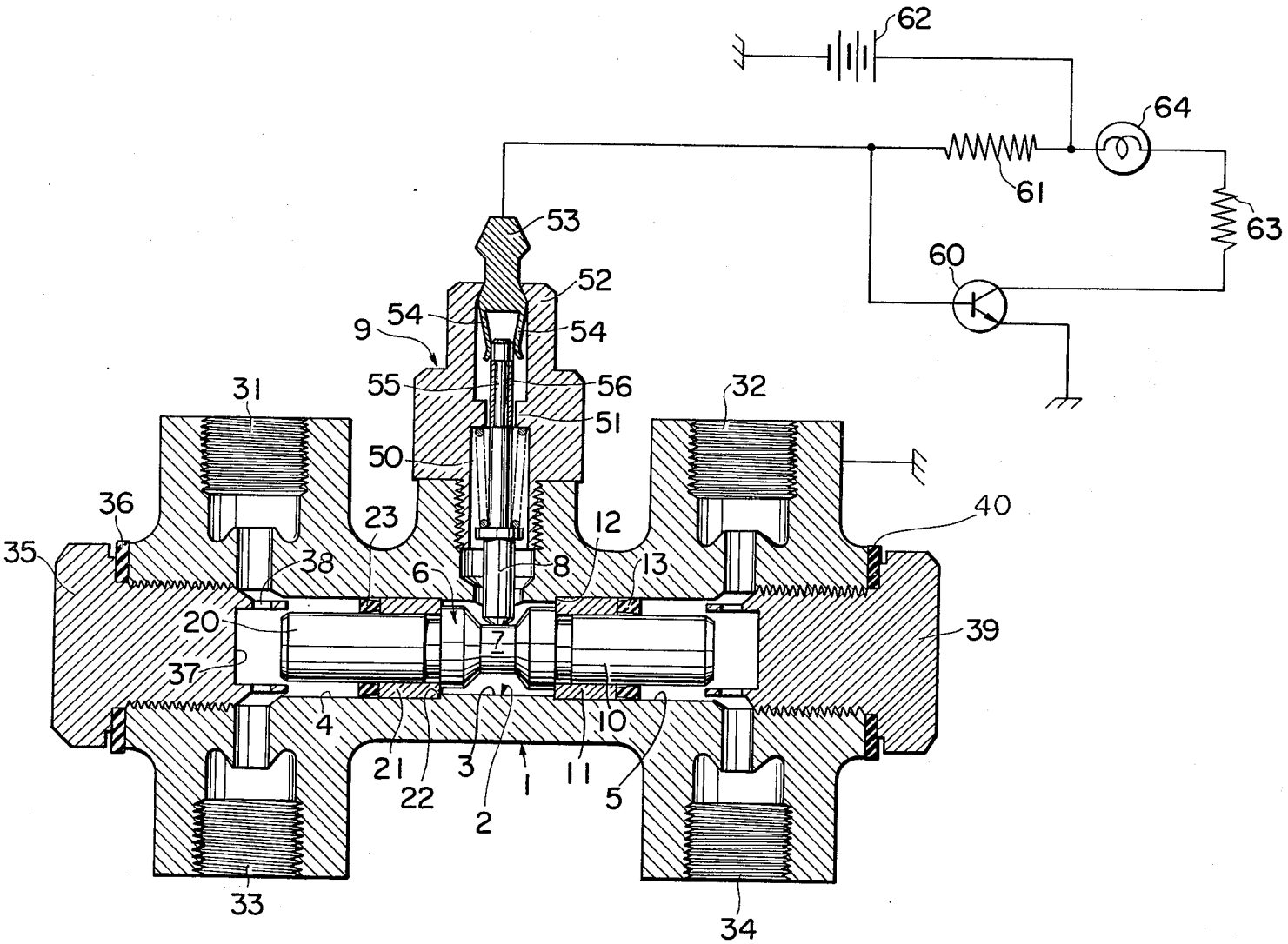
63
64
61
60
62
40
39
32
34
13
12
10
5
11
1
2
3
22
21
4
33
37
20
38
31
36
35
23
6
7
8
50
55
9
54
53
52
56
51

BRAKE FAILURE INDICATOR

BACKGROUND OF THE INVENTION

This invention relates to an apparatus for providing an indication to a vehicle operator of failure of either one of separate hydraulic braking circuits.

In automotive vehicles having dual master cylinders for separate hydraulic circuits to different sets of brakes, it has already been contemplated to mount on the automotive vehicles an equipment adapted to visually or auditorily indicate of failure (loss of fluid braking pressure) of either one of the braking fluid circuits by means of an electric circuit, and to warn the driver of the vehicle of the likelihood of a danger.

SUMMARY OF THE INVENTION

Now the present invention relates more particularly to an indicator of this character which is capable of taking further due consideration of self-ruin or self-inactivity of such electric circuit in addition to the failure of fluid circuits.

To this end, the indicator according to this invention is characterized essentially, in that it comprises pressure responsive means responsive to the pressure in both of the sets of brakes and normally being in a first condition in response to the pressure in both sets being approximately normal and being actuable to a second condition in response to the pressure in either set being not normal and remaining in said second condition even after deactuation of the vehicle brakes, and signal means for providing a visual or audio signal by means of an electric circuit in response to either the second condition or self-deactuation of the signal means.

With the indicator according to this invention either the failure of the brakes or the failure of the electric circuit may be safely indicated to the vehicle driver.

BRIEF DESCRIPTION OF THE DRAWING

The FIGURE is a longitudinal sectional view of the indicator of the present invention.

DESCRIPTION OF THE PREFERRED EMBODIMENT

The housing 1 has a generally central longitudinally extending bore 2 which includes a central reduced diameter bore portion 3 and oppositely located increased diameter bore portions 4 and 5. A detent member 6 is slidably located in bore portion 3 and has an annular groove 7 which normally receives a plunger 8 of an electric switch 9. The switch 9 with plunger 8 in groove 7 is deactuated and hence no signal will be provided to the vehicle operator. Upon movement of member 6 either to the right or left, in response to failure of either of the brake systems, the plunger 8 will be moved out of groove 7 and actuate switch 9 whereby an indication, i.e. visual, audio, etc., can be provided to the vehicle operator.

A piston portion 10 is located in bore portion 5 and is slidably supported by an annular bushing 11 which in turn is slidably located in bore portion 5. The pressure in bore portion 5 will normally urges the detent means 6 to the left and bushing 11 to a shoulder 12 defined by the junction of bore portions 3 and 5. An O-ring 13 on piston portion 10 provides a seal between bore portions 5 and 3.

The force applied on detent member 6 by piston portion 10 is normally opposed by another piston portion 20 of the detent member 6 located in bore portion 4. The piston 20 is slidably supported in an annular bushing 21 which is slidably located in bore portion 4. The pressure in bore portion 4 will normally urge piston portion, i.e. detent member 6 to the right and bushing 21 to a shoulder 22 defined by the junction of bore portions 3 and 4. An O-ring 23 is located on piston portion 20 and provides a seal between bore portions 4 and 3. Note that the pressure in bore portions 4 and 5 will be substantially equal and hence the forces on opposite sides of detent member 6 will be equal and detent member 6 will not move. In the event of failure of a brake system connecting to bore portion 5, the pressure in bore portion 4 will exceed that in bore portion 5 whereby piston 20, and hence detent member 6, will move to the right actuating the switch 9 to provide an indication to the vehicle operator. In the event of failure of the other brake system reverse will take place.

Note that the failure indicating apparatus will automatically reset upon correction of the failure condition (or termination of a transient condition causing unwanted actuation). In the event of failure of the brake system connecting to bore portion 4 as the detent 6 is moved to the right it will move piston 10 and bushing 11 to the right. Upon correction of the failure condition and upon the next application of the brake pedal (not shown), the fluid pressure in bore portions 4 and 5 will again be substantially the same. The force via piston 20 urging the detent member 6 to the right will be determined solely by the effect of the area of piston portion 20; however, the force on detent member 6 urging it to the left will be determined not only by the effect of the area of piston portion 10, but also by the effect of the area of the bushing 11.

Since the forces on piston portion 10 and 20 will be substantially the same, the extra force via bushing 11 will cause the detent member 6 to be moved to the left until bushing 11 engages shoulder 12 and the forces on member 6 will be equalized and it will have been returned to its deactuated position at which the switch 9 will be deactuated. A similar sequence will occur upon failure and repair of the other brake system via the action of the other bushing 21. Note that the return is automatic and in the event of a false indication resulting from a transient the apparatus will automatically return to its original position.

The indicating apparatus of the present invention is adapted for equipping a standard vehicle braking system having dual master cylinders for separate hydraulic fluid circuits such as, for example, a front and rear brake circuits, for indicating of failure of either of the circuits and failure of an electric circuit which will be explained as the description proceeds. As usual, the master cylinder is operated by a driver through the brake pedal to deliver brake fluid under pressure through the bore portions 4 and 5 to a brake such as front brakes and to another brake such as rear brake respectively. For convenience, the description will hereinbelow proceed as if, for example, the bore portion 4 is connected to the front brake while the other bore portion 5 is connected to the rear brake. However, this invention is not restricted to that.

The housing 1 has inlets 31 and 32 leading to the corresponding pressurizing chambers (not shown) of the master cylinder. The housing also has outlets 33 and 34 leading to the front brake cylinders (not shown) and the rear brake cylinders (not shown) respectively.

The inlet 31 and outlet 33 are connected to bore portion 4 while the inlet 32 and outlet 34 are connected to bore portion 5. A cap 35 closes bore portion 4 and gasket 36 is fitted between the housing 1 and the cap to prevent leakage therebetween. It will be seen that the cap 35 has a central blind bore 37 at its end facing into the chamber or bore portion 4. The wall of the blind bore 37 is provided a plurality of holes 38 to permit free communication between inlet 31 and outlet 33. The same structural parts are provided for the other cap 39 which also closes bore portion 5 in the same manner as the cap 37 and a gasket 40 is fitted between the housing 1 and the cap 39.

In regard to the switch 9, the plunger 8 is normally spring biased toward engagement with the groove 7 of the detent member 6, by a spring 50. The plunger 8 is slidably supported by a rib portion 51 of the cap 52 of switch 9 and forked terminal 53. A plurality of fingers 54 of the terminal normally resiliently clasp the plunger 8 but the spring pressure of the fingers 54 is light and does not affect operation of plunger 8 as the detent member 6 moves to provide cam action. The plunger 8 has a reduced diameter portion 55 and a tubular rubber member 56 is located in reduced diameter portion 55 and provides an electric insulating for the switch 9 to be described. Note that the cap 52 is formed of electric insulating material such as rubber or the like.

A NPN transistor 60, warning or indicating lamp 64, resistors 61 and 63, and an electric supplying source 62 are connected each other as shown by the solid lines. The base electrode of NPN transistor 60 is further connected through resistor 61 to a terminal of current source 62 and also to terminal 53 of the switch 9. The transistor has a collector emiter circuit connected to ground and also to the terminal of current source 62 via resistor 63 and warning lamp 64. When transistor 60 conducts, current is permitted to flow through lamp 64, resistor 63 and transistor 60 to thereby exert the lamp 64 to be illuminated. The lamp is shown for the purpose of illustrating the invention and should not be interpreted to limit the invention. The lamp may be replaced by any other warning means such as, for example, an audio device, as desired.

In case of failure of either one of the fluid braking circuits (loss of fluid braking pressure), the detent means 6 moves to either the right or left so that plunger 8 is upward moved. Such movement causes the switch to be opened to thereby block connection between the base electrode of transistor 60 and ground via housing 1. The potential at the base electrode is hence increased to cause the collector and emiter circuit to conduct. The lamp 64 is accordingly energized to be illuminated. The vehicle driver is thus warned of the likelihood of a danger caused by failure of either one of the fluid circuits.

It should be noted that the potential at the base electrode of transistor 60 is normally limited to ground but is increased in case of such disconnection from ground as above noted to cause transistor 60 to conduct.

The same actuation as above noted will take place in case of any ruin or insufficiency of electric connection between the electrode of transistor 60 and ground. Such actuation is readily understood by those who skilled in the art so that a duplicated description will not be required.

From the foregoing it will be noted that the apparatus according to the present invention is enabled to warn the driver of the vehicle of likelihood of a danger caused by failure of either of the separated fluid braking circuits as well as by failure or ruin of the electric circuit. A wider safety is ensured for the vehicle braking than is expected conventionally.

What is claimed is:

1. In a brake system for a vehicle having two sets of brake, the improvement comprising a failure indicating means in response to a failure of either of the sets of brakes, said failure indicating means comprising a fluid pressure differential-responsive means normally being in a first position in response to pressures in both sets of brakes, said first position being approximately normal and being shifted to a second position in response to fluid pressure differential between the two sets of brakes, a displaceable means operatively connected to said pressure differential responsive means, and an electrically operable signal means associated with and controlled by said displaceable means, said electrically operable signal means comprising a normally active current circuit, a first switching member in the normally active current circuit operatively connected to said displaceable means, a second switching member responsive to the potential of the normally active current circuit, a signal device, and an operating current-supplying circuit for energizing the signal device, said second switching member forming the operating current-supplying circuit in order thereby to indicate occurrence of such pressure differential in the pressure differential responsive means;

said displaceable means comprising a plunger having a conductor portion and an electrically insulating portion to form the first switching member, said conductor portion forming the normally active circuit while said insulating portion blocking the normally active current circuit in dependency upon displacement of the displaceable means.

2. An apparatus as defined in claim 1, further comprising a terminal provided in the normally active current circuit associatable with either said conductor portion or said insulating portion so as to form the first switching member in the normally active current circuit.

3. An apparatus as defined in claim 2 wherein said normally active current circuit is completed from the ground through an electric supply source, said terminal, said conductor portion of the plunger and a housing of the pressure differential responsive means to the ground.

4. An apparatus as defined in claim 3 wherein said second switching member is a transistor having a base electrode and a collector-and-emitter circuit, the base electrode being electrically connected to said normally active current circuit at a point between the electric supply source and the ground while the collector-and-emitter circuit being a component of the operating current-supplying circuit.

5. An apparatus as defined in claim 1, wherein said pressure differential responsive means comprises a housing 1, a generally longitudinally extending bore 2 therein, said bore 2 having a central reduced diameter bore portion 3 and oppositely located increased diameter bore portions 4 and 5, a piston in bore 2 having a central tapered cam groove 7, oppositely located piston portions 10 and 20, a pair of bushings 11 and 21 slidably supporting the piston portions and being in turn slidably located in increased diameter bore portions 4 and 5 normally abutting against the ends of the central reduced diameter bore portion 3, both ends of the piston being exposed against the fluid pressures of said two sets of fluid brakes, said plunger 8 engaging the central tapered cam groove 7 to effect a cam function therebetween.

* * * * *